United States Patent [19]

Halavais

[11] Patent Number: 4,566,291

[45] Date of Patent: Jan. 28, 1986

[54] CLOSED CYCLE CRYOGENIC COOLING APPARATUS

[75] Inventor: Richard A. Halavais, Pompton Lakes, N.J.

[73] Assignee: General Pneumatics Corporation, Orange, N.J.

[21] Appl. No.: 660,549

[22] Filed: Oct. 15, 1984

Related U.S. Application Data

[63] Continuation of Ser. No. 466,016, Feb. 14, 1983, abandoned.

[51] Int. Cl.[4] ..... F25D 9/00

[52] U.S. Cl. ..... 62/402; 62/467

[58] Field of Search ..... 62/6, 86–88, 62/402, 467, 514 R

[56] References Cited

U.S. PATENT DOCUMENTS

| | | | |
|---|---|---|---|
| 1,547,066 | 7/1925 | Nuss . | |
| 1,759,617 | 5/1930 | Hoerbiger . | |
| 2,486,034 | 10/1949 | Katzow | 62/87 |
| 2,494,120 | 1/1950 | Ferro, Jr. | 62/87 |
| 2,775,870 | 1/1957 | Bruce et al. | 62/1 |
| 3,000,320 | 9/1961 | Ring | 103/44 |
| 3,036,526 | 5/1962 | Hise | 103/44 |
| 3,048,021 | 8/1962 | Coles et al. | 62/36 |
| 3,098,732 | 7/1963 | Dennis | 62/9 |
| 3,109,725 | 11/1963 | Flynn | 62/9 |
| 3,190,545 | 6/1965 | Weber et al. | 230/183 |
| 3,194,026 | 7/1965 | La Fleur | 62/402 |
| 3,234,738 | 2/1968 | Cook | 62/402 |
| 3,241,327 | 3/1966 | La Fleur | 62/402 |
| 3,277,658 | 10/1966 | Leonard, Jr. | 62/87 |
| 3,286,911 | 11/1966 | Clarke | 230/55 |
| 3,368,360 | 2/1968 | Daly et al. | 62/6 |
| 3,568,214 | 3/1971 | Goldschmied | 3/1 |
| 3,577,880 | 5/1971 | Leslie | 62/401 |
| 3,613,387 | 10/1971 | Collins | 62/100 |
| 3,696,637 | 10/1972 | Ness et al. | 62/402 |
| 3,708,996 | 1/1973 | Wurm | 62/116 |
| 3,763,663 | 10/1973 | Schlichtig | 62/498 |
| 3,999,402 | 12/1976 | Nelson | 62/403 |
| 3,999,896 | 12/1976 | Sebastiani | 417/383 |
| 4,215,548 | 8/1980 | Beremand | 60/520 |
| 4,418,547 | 12/1983 | Clark, Jr. | 62/467 R |

OTHER PUBLICATIONS

Proceedings of the Internat'l. Cryogenic Engineering Conference, Kyoto, 1974, "N4 Experiments on a Modified Kirk Cycle", pp. 361–366.

*Primary Examiner*—Ronald C. Capossela
*Attorney, Agent, or Firm*—Shapiro and Shapiro

[57] ABSTRACT

A miniaturized high efficiency closed cycle cryogenic cooling system employs an integral electrically-actuated diaphragm compressor and expander arranged to enable the work of expansion of a portion of compressed gas to be applied to the compressor via a fluid coupling to reduce the external input power requirements of the compressor. Another portion of compressed gas is expanded through an expansion valve and liquefied at the cryogenic temperature. The expanded gas from the expander and the expansion valve is returned to the compressor through a heat exchanger to pre cool the portions of compressed gas prior to expansion.

37 Claims, 15 Drawing Figures

CLOSED CYCLE CRYOGENIC COOLING APPARATUS

This is a continuation application of Ser. No. 466,016, filed Feb. 14, 1983, now abandoned.

BACKGROUND OF THE INVENTION

This invention relates generally to low temperature refrigeration systems, and more particularly to closed cycle cryogenic cooling systems and apparatus.

Cooling apparatus and systems capable of producing very low (cryogenic) temperatures find applications in many different fields, such as in electronics. The proper operation of many electronic or electro-optical devices, such as infrared, X-ray and gamma ray detectors, solid state lasers, and low noise amplifiers, requires that the devices be cooled to cryogenic temperatures. Moreover, such devices and their associated cooling systems must often operate under remote or adverse environmental conditions, such as aboard spacecraft, aircraft or other vehicles, wherein space and weight are at a premium and where high reliability and long operating life are required. In order to satisfy these requirements, open cycle cooling systems commonly have been employed. One such open cycle cooling system stores refrigerant gas under high pressure in a pressure vessel. Upon initiation, the gas flows through a heat exchanger to a Joule-Thomson (J-T) expansion valve located within a dewar where expansion causes liquefaction of the refrigerant. The liquid refrigerant is puddled to cool the device. Cold refrigerant vapor is then routed back through the heat exchanger to cool the incoming gas and is then vented out of the system. The pressure vessel used for storing the refrigerant must be removed, refilled, and returned to the system quite frequently. Although this system has the advantage of being quite simple and, thus, has good reliability, it is not very cost-effective and possesses a number of other disadvantages. It has a rather low efficiency. It requires high maintenance, and there is a possibility of contamination entering the system, which can cause it to malfunction, because of the frequent handling of the pressure vessel that is required. Moreover, in some applications, e.g., aboard spacecraft, replenishment or replacement of the refrigerant pressure vessel may be impractical.

Closed cycle cooling systems, which recompress and reuse refrigerant gas rather than venting it, are capable of higher efficiency than open cycle systems and do not require the same type of maintenance. However, closed cycle cooling systems are generally more complicated than open cycle systems and, therefore, may have lower reliability and lower operating life. Moreover, most closed cycle cooling systems do not lend themselves to miniaturization, and heretofore there has not been available a small, lightweight closed cycle cooling system having the desired reliability, efficiency and operating life that is capable of replacing open cycle systems in the above-described applications, despite the long-standing recognition of the problems associated with open cycle systems and despite considerable efforts directed toward developing suitable closed cycle systems.

SUMMARY OF THE INVENTION

The invention affords miniature closed cycle cooling apparatus that avoid the foregoing disadvantages and that satisfy the above-stated requirements. Systems in accordance with the invention are rugged and lightweight, possess exceptionally high reliability and efficiency, and are capable of operating for long periods of time in remote or adverse environments. The systems have a rather simple construction and have low input power requirements. They are capable of operating over a wide cryogenic temperature range between approximately 4.2° K. and 100° K. with any of a number of common refrigerants such as helium, neon, nitrogen, argon or methane, without modification, are capable of very rapid cool down from high ambient temperatures, and are capable of maintaining very accurately a preselected cryogenic temperature. The systems may be constructed to have a size of the order of four inches in diameter by five inches in length, or smaller, and a weight of the order of four and one-half to six pounds, making them ideal for use aboard spacecraft or aircraft. These advantages and highly desirable characteristics are due, in part, to novel compressor/expander apparatus provided by the invention that is very efficient, highly reliable, has a long operating life and requires a minimum of maintenance, and that is readily miniaturized.

Briefly stated, in one aspect, the invention provides cooling apparatus that comprises compressor means for compressing a gas and for providing a compressed gas output, expander means for enabling the expansion of a portion of the compressed gas and for enabling the expansion of the compressed gas to perform work, and fluid means connecting the compressor means and the expander means for applying the work produced by the expansion of the gas to the compressor means to assist the compressor means in compressing the gas.

In another aspect, the invention affords cooling apparatus that comprises diaphragm compressor means for compressing a gas, first expander means for receiving a first portion of compressed gas from the compressor means and for enabling expansion of the gas and for enabling the expansion of the gas to perform work, means for applying the work of expansion to the compressor means to assist the compressor means in compressing the gas, second expander means for receiving a second portion of compressed gas from the compressor means and for expanding the gas to liquefy a part thereof, and means for returning the expanded gas to the compressor means for recompression.

In yet another aspect, the invention affords cooling apparatus comprising compressor means for compressing a gas, expander means comprising a movable member disposed within an expansion chamber for enabling expansion of the gas and for enabling the expansion of the gas to perform work, the expansion chamber having an inlet valve and an outlet valve for respectively admitting and discharging gas and the valves being arranged so as to be operated by the movable member, and means for applying said work to the compressor means.

In accordance with more specific aspects, the invention affords an integral electrically-actuated fluid-operated compressor and expander apparatus that enables the work of expansion of a precooled pressurized refrigerant gas to be returned to the compressor so as to reduce the power input required to compress gas. The compressor/expander is constructed so as to avoid sliding seals or rubbing parts that may contribute to refrigerant contamination, and employs novel inlet and outlet valve arrangements. The manner in which this is accomplished will be described more fully hereinafter.

BRIEF DESCRIPTION OF THE DRAWINGS

FIGS. 1OA and 10B are, respectively, enlarged fragmentary plan and sectional views of portions of FIGS. 8 and 9 illustrating a preferred outlet valve arrangement;

DESCRIPTION OF THE PREFERRED EMBODIMENT

The invention is primarily intended for use on vehicles, where minimum size and weight are very important, to provide cryogenic cooling to an electronic or electro-optical device, and it will be described in that context. However, this is illustrative of only one utility of the invention and, as will become apparent, the invention is well suited for other purposes.

Figure 1:
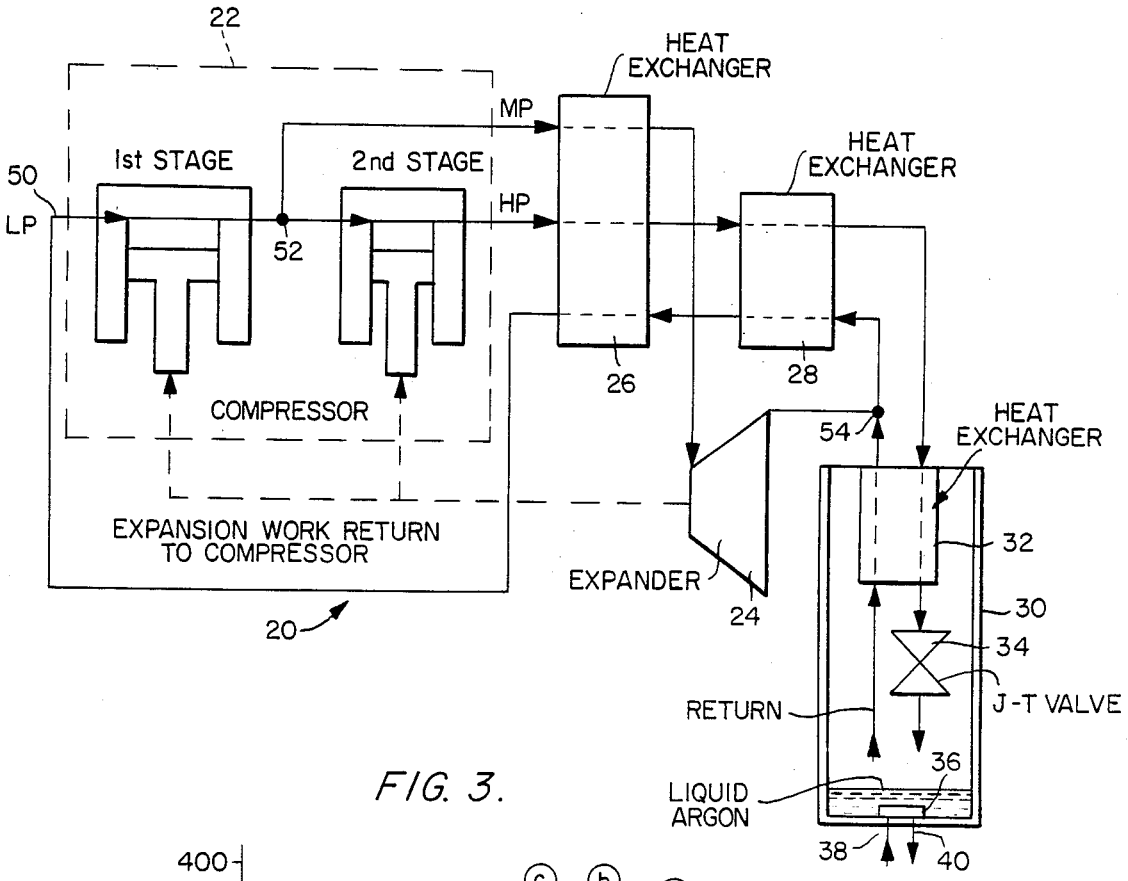
FIG. 1 is a block diagram illustrating schematically a closed cycle cooling system in accordance with the invention.

FIG. 1 illustrates schematically a closed cycle cooling system 20 in accordance with the invention. As shown, the system comprises a dual-stage compressor 22, an expander 24, first and second reversing heat exchangers 26 and 28, respectively, and a pressurized container or dewar 30. Within the dewar there is a cryostat comprising another heat exchanger 32 and a Joule-Thomson (J-T) expansion valve 34. A device 36 to be cooled may be placed in the bottom of the dewar, and may have appropriate input and output connections 38 and 40 thereto through the wall of the dewar.

Low pressure (LP) refrigerant gas, preferably argon, for example, enters the first stage of the compressor at 50 where it is compressed to a predetermined medium pressure (MP). A portion (for example 75%) of the pressurized gas from the first stage is tapped off at 52 and is supplied to heat exchanger 26, where it is cooled, and thence to expander 24 where additional heat is removed by allowing the gas to undergo expansion and to perform work. This expansion work is applied to the compressor (as indicated by the dotted lines) where it aids in the compression cycle, thereby reducing the amount of input power required by the compressor. The remaining 25% of the gas from the first stage of the compressor is further compressed in the second stage to a high pressure (HP) and is then routed through heat exchangers 26 and 28 in series, where it is cooled and purified (by lowering its temperature sufficiently to cause precipitation of contaminates), to the cryostat. Within the cryostat, the precooled high pressure gas is further cooled in heat exchanger 32 (by returning cold vapor) and undergoes expansion and liquefaction at the output of J-T valve 34. The liquid refrigerant within the dewar is at a cryogenic temperature and serves to cool device 36. Cold vapor returned from the dewar through heat exchanger 32 is joined at 54 with the expanded cold gas from expander 24 and is returned to the low pressure side of the compressor through heat exchangers 26 and 28, where it cools the medium pressure and high pressure gas flowing therethrough.

Cooling system 20 is based upon a modified Claude cycle system which is widely used in the gas liquefaction industry for liquefying air and other gases. Industrial systems, however, employ large rather complicated rotary turbine-type compressors and expanders, mechanically coupled together, which do not lend themselves to miniaturization. Moreover, these systems do not possess the requisite characteristics necessary for unattended operation under remote or adverse environmental conditions. As will become apparent, the invention affords a system which has a rather simple construction, which is capable of being miniaturized, and which is capable of a rather high figure of merit, defined as the ratio of the theoretical minimum work requirement to the actual work requirement of the system, of the order of 0.378. Moreover, the various operating parameters of the system do not exhibit a critical interrelationship or inter-dependency as do those of some other types of closed cycle systems.

Figure 3:
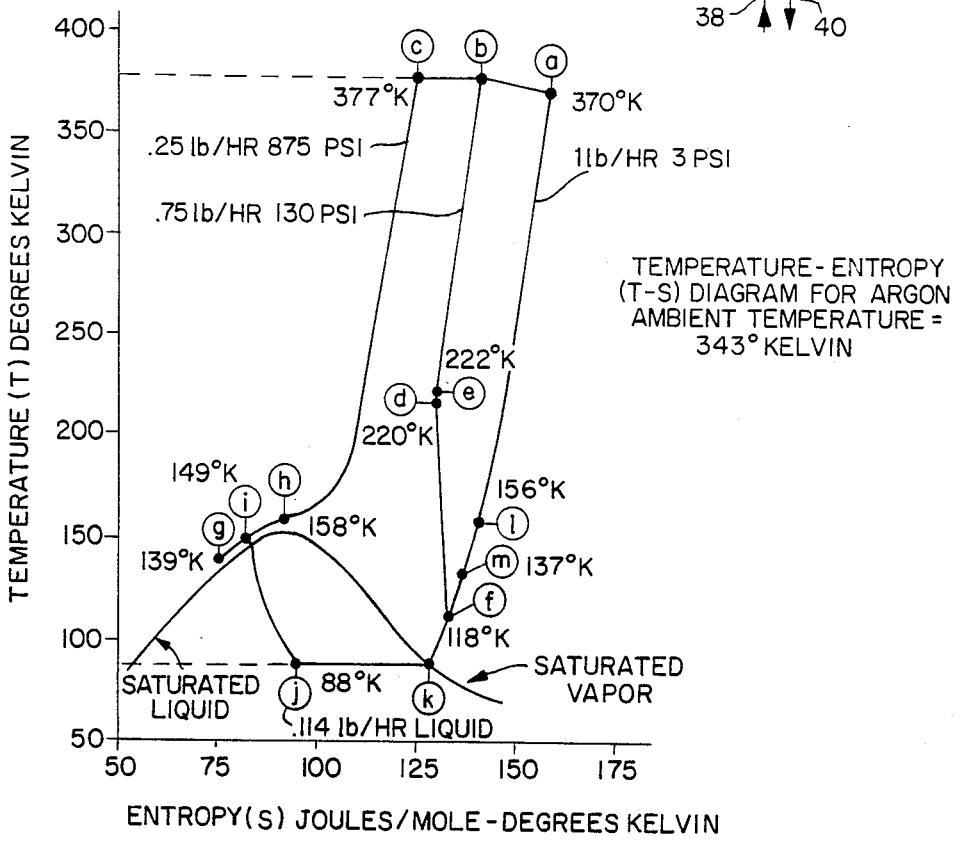
FIG. 3 is a temperature-entropy (T-S) diagram of the thermodynamic cycle of the system of FIG. 2 employing argon as a refrigerant.
Figure 2:
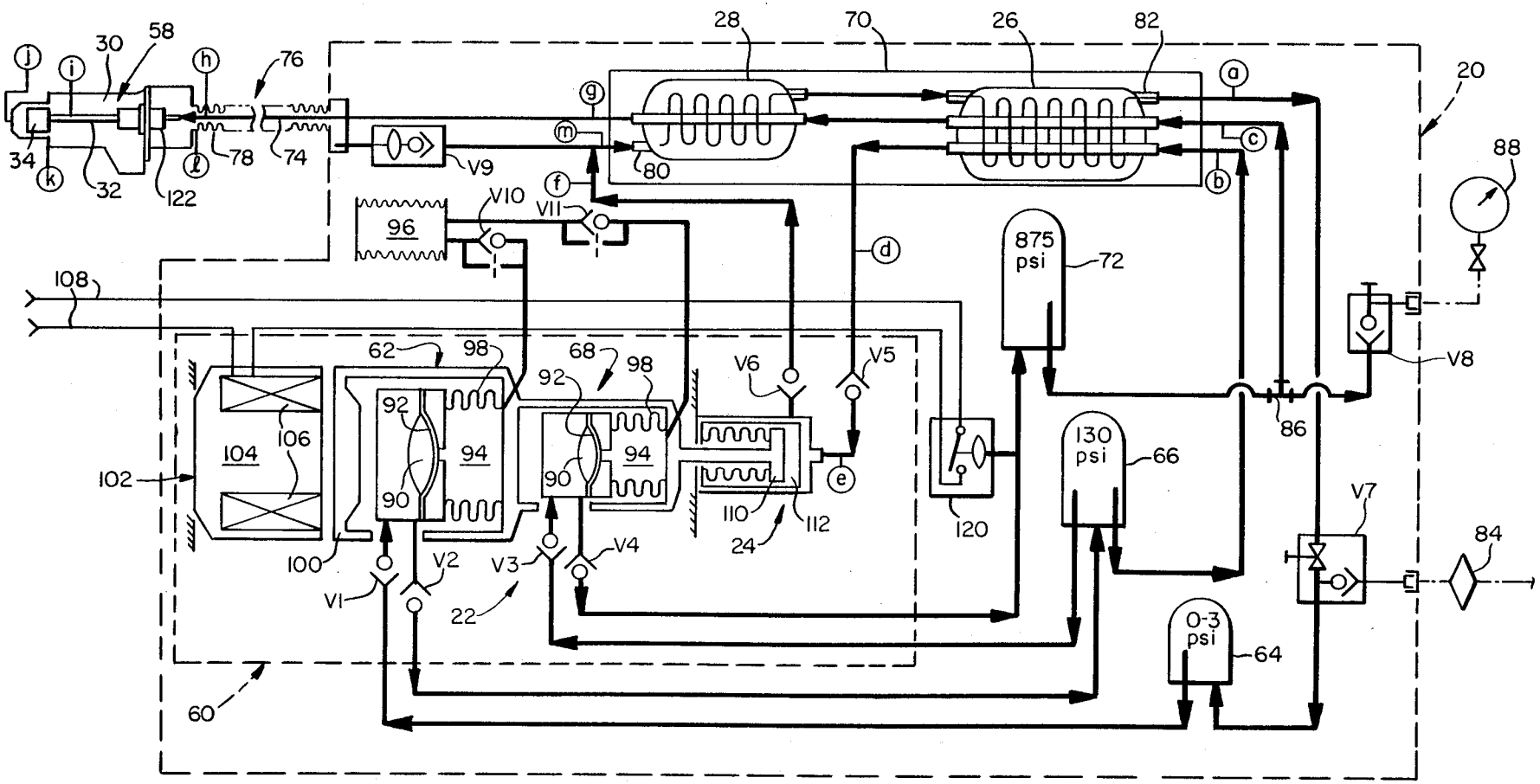
FIG. 2 is a schematic diagram illustrating the system of FIG. 1 in somewhat greater detail.

FIG. 2 illustrates the closed cycle cooling system of the invention in more detail. The heart of the system is a compressor/expander 60 which, as will be described in more detail hereinafter, preferably comprises an integral, electrically-actuated fluid-operated two-stage diaphragm compressor 22 and piston expander 24. The system of FIG. 2 will be described assuming that the refrigerant is argon and that it is desired to provide a cryostat output temperature of 88° K. at a total mass flow rate of 0.25 lb/hr (pounds per hour) and a pressure of 3 psi (pounds per square inch). FIG. 3 is a temperature-entropy (T-S) diagram illustrating the thermodynamic cycle of the system for an ambient temperature of 343° K. (Kelvin). Temperatures, pressures and mass flow rates at various points in the system are indicated by the encircled lower case letters in FIGS. 2 and 3. As will become apparent, however, the system may employ other refrigerant gases and may be readily designed for other operating parameters.

Referring to FIG. 2, low pressure refrigerant gas enters the first stage 62 of the compressor from low-pressure, e.g., 0–3 psi, accumulator 64 via an inlet check valve V1. The first stage compresses the gas to a medium pressure of approximately 130 psi. The compressed gas exits the first stage of the compressor via an outlet check valve V2 and is supplied to a medium pressure (130 psi) accumulator 66. From accumulator 66, approximately 25% of the gas is returned to the compressor where it enters the second stage 68 via an inlet check valve V3, (the amount returned being determined by the volume of the second stage), and the remaining 75% of the gas is supplied to heat exchanger 26. Heat exchangers 26 and 28 may be the first and second stages, respectively, of a reversing heat exchanger 70. Heat exchanger 70 may also be a tapped heat exchanger having first and second portions 26 and 28, and may be of conventional construction. The second stage of the compressor compresses the gas entering valve V3 to a high pressure of approximately 875 psi. The compressed gas exits the second stage via an outlet check valve V4 and is routed to a high pressure (875 psi) accumulator 72. From the high pressure accumulator, the compressed gas is then routed through both the first and second stages 26 and 28 of heat exchanger 70 and to the cryostat 58 via the inner line 74 of a coaxial bidirectional transfer line 76. In the cryostat, the high pressure gas passes through J-T expansion valve 34 where it undergoes expansion and liquefaction in the dewar 30. Cold vapor from the dewar is returned to the system via an outer return line 78 of coaxial transfer line 76 that surrounds inner line 74. The returning cold vapor is fed through a back pressure regulator valve V9 to the return inlet 80 of the second stage 28 of heat exchanger 70.

The 75% portion of the medium pressure (130 psi) gas from accumulator 66 that passes through the first stage of the heat exchanger enters expander 24 via an inlet valve V5. In the expander, the gas is allowed to expand and to do work, thereby lowering its temperature. The expanded cold gas exits the expander via an outlet valve V6 and is joined with the returning cold vapor from the dewar at the return inlet 80 of the second stage of the heat exchanger. As the returning cold vapor from the dewar and the cold gas from the expander flow through the heat exchanger, they absorb heat from the high pressure gas flowing to the cryostat and from the medium pressure gas flowing to the expander, thus cooling and purifying these gases. From the return outlet 82 of the first stage of the heat exchanger, the return gases are supplied to accumulator 64, from which they are recycled into the first stage of the compressor. As is shown in FIG. 2, the system may also include a fill valve V7 to enable the system to be charged with refrigerant (preferably through a filter 84), and may include a cut-off valve V8 connected to a junction 86 in the high pressure line from accumulator 72 and adapted for connection to a pressure gauge 88. Accumulators 64, 66 and 72 constitute surge tanks for reducing pressure surges in the system.

As is shown schematically in FIG. 2, and as will be described in detail shortly, each stage of the compressor 22 of compressor/expander 60 comprises a cavity 90 communicating with the inlet and outlet valves of the compressor stage. A displaceable resilient diaphragm member 92 is disposed within each cavity and is arranged such that one side of the diaphragm constitutes one wall of the cavity. The opposite side of the diaphragm communicates with a reservoir 94 containing a fluid, which may be either a gas or a liquid. A preferred liquid is fluorosilicon oil. The fluid reservoir of each stage may be in communication with an oil (or other fluid) accumulator 96 via respective by-pass orifice check valves V10 and V11, as shown, to enable the reservoirs to be maintained full of oil. Each reservoir is preferably formed as a resilient bellows 98 connected at one end to a movable member 100, a portion of which constitutes the armature of a solenoid 102. The solenoid, which may comprise a magnetic core 104 and a coil 106, is adapted to be energized by a pulsed DC voltage on electrical conductors 108. When the solenoid is energized, member 100 is moved to the left (in FIG. 2) decreasing the volumes of the reservoirs 94 and causing the oil to apply pressure to diaphragms 92 to displace the diaphragms to the left. This reduces the volume of the cavities and compresses the gas within the cavities. As later described, the gas is compressed during the first part of the diaphragm stroke (displacement) and is expelled from the cavity during the latter part of the compression stroke.

As is also shown in FIG. 2, a portion of member 100 constitutes a piston 110 which is disposed within an expansion chamber 112 of expander 24. During operation, inlet valve V5 of the expander opens (in a manner which will be described) to admit a charge of 130 psi gas into the chamber. As the pressurized gas enters the expansion chamber, it acts against piston 110 and does work by assisting the solenoid in moving member 100 to the left (in the figure) during the compression stroke, thereby reducing the work and input power requirements of the solenoid to compress the gas. As the piston moves to the left, the volume of the expansion chamber increases, allowing the gas to expand and its pressure and temperature to drop. When the solenoid is de-energized, member 100 and piston 110 move back to the right because of the resiliency of the bellows and because of the force transmitted through the oil to the member by pressurized gas entering the cavities and acting against the diaphragms. This forces the cold expanded gas out of the chamber through valve V6. At the same time, the oil pressure on the diaphragms decreases, allowing the diaphragms to return to their original positions and enabling a new charge of gas to enter the cavities via inlet valves V1 and V3.

Preferably, the solenoid is actuated by a rectangular wave DC voltage at approximately a 50 Hz rate, for example. The DC voltage causes member 100 to undergo reciprocating motion, producing compression and discharge of pressurized gas from the cavities and allowing expansion of gas in expansion chamber 112 as the member moves to the left, and permitting a new charge of gas to enter the cavities while discharging expanded gas from the expander as the member moves back to the right. The duty cycle of the rectangular wave DC voltage may be varied so as to vary the compression stroke, and the voltage on-time may be selected so that the voltage turns off just prior to the desired end of the stroke in order to take advantage of the momentum of the movable member to complete the stroke. This saves power and enables stresses due to the solenoid armature impacting the solenoid core to be minimized or to be eliminated (as by adjusting the voltage on-time such that the solenoid armature stops just as it reaches the core). The system may also include a pressure regulator switch 120 connected in series with electrical conductors 108 that supply power to the solenoid. The switch monitors the pressure in the inlet line of accumulator 72 and opens and closes to control actuation of the solenoid to maintain the pressure in accumulator 72 at 875 psi.

In the form illustrated in FIG. 2, cryostat 58 comprises a J-T valve 34 located on the end of a tubular member 32 (which corresponds to heat exchanger 32 of FIG. 1). The cryostat is disposed within pressurized dewar 30 and may be connected to the inner line 74 of transfer line 76 by a connector 122, for example. The transfer line may comprise a flexible inner line 74, as of stainless steel, surrounded by an outer flexible bellows, as of electro-deposited nickel, that forms return line 78. The transfer line may also be covered with insulation (not illustrated) and should be kept short (e.g., 24 inches or less) in order to minimize the heat loss therefrom.

It should be noted that the gas expansion within expander 24 is a thermodynamically reversible process and, therefore, is more efficient than the gas expansion through the J-T valve 34, which is an irreversible process. Thus, by allowing the majority (75%) of the output of the first compressor stage to undergo expansion in expander 24 and to do work, while compressing the remaining portion (25%) to a high pressure and allowing it to undergo expansion in the J-T valve, the solenoid work per unit of gas liquefied is reduced and higher efficiency is obtained. From the T-S diagram of FIG. 3, it can be noted that the temperature of the gas entering the expander at point e is 222° K. After undergoing expansion, the gas temperature at f (at return inlet 80 of the second stage of heat exchanger 70) is 118° K. In the heat exchanger, the combined cold vapor from the dewar and the cold expanded gas from expander 24 effects substantial precooling of the high pressure gas flowing through the heat exchanger such that the temperature of the high pressure gas is lowered from 377° K. at the inlet b, c of the heat exchanger to 139° K. at its outlet g, and such that after expansion from the J-T valve 34, the temperature is 88° K. (j,k), assuming a 24-inch coaxial transfer line 76 between the system and the cryostat.

The system of FIG. 2 is capable of providing cool down from an ambient temperature of approximately 160° F. to a temperature of less than 100° K. in approximately 3¼ minutes with only 50 watts of power required for the cool down phase, and of sustaining a one-quarter watt cooling capacity at liquid argon temperature with only 10 watts of power. Moreover, the liquid temperature of the refrigerant in the dewar is a function of the internal pressure of the dewar, and the liquid temperature can be very accurately controlled by controlling the internal pressure. Back pressure regulator valve V9 enables the internal pressure within the dewar to be maintained at a preselected value so as to accurately maintain a desired liquid temperature. This also affords very good temperature stability. The system of FIG. 2 offers significant advantages over cold gas-type refrigerators, in that the liquefaction process provides a much more efficient heat transfer mechanism and the object being cooled will stabilize at a temperature very nearly equal to the liquid temperature of the refrigerant.

FIGS. 4–12 illustrate in more detail a preferred form of an integral compressor/expander 60 in accordance with the invention. As shown particularly in FIGS. 4–6, compressor/expander 60 may have a generally cylindrical multi-part housing comprising a cup-shaped solenoid housing 130, a compressor plate 132, a cylindrical housing extension 134 and an expander housing 136. The parts may be all formed of aluminum, for example, and may be held together by a plurality of bolts 138 and 140, as shown in FIGS. 5–7B. Solenoid housing 130 may be formed with a plurality of radially directed heat-dissipating fins 142 which extend substantially about the circumference thereof. The magnetic core 104 of the solenoid may be secured to an end plate 144 of the solenoid housing, as by a screw 146, as shown. An electrical connector 148 adapted for connection to electrical conductors 108 may extend through end plate 144 to enable power to be supplied to solenoid coil 106, which may be disposed within an annular slot in the magnetic core as shown. A solenoid armature 150 is disposed within the solenoid housing between the magnetic core 104 and the end wall 152 of the solenoid housing. Upon the solenoid being energized, the armature moves to the left in FIG. 4 and may engage the magnetic core. The armature stroke may be of the order of 0.060 inch.

Figure 4:
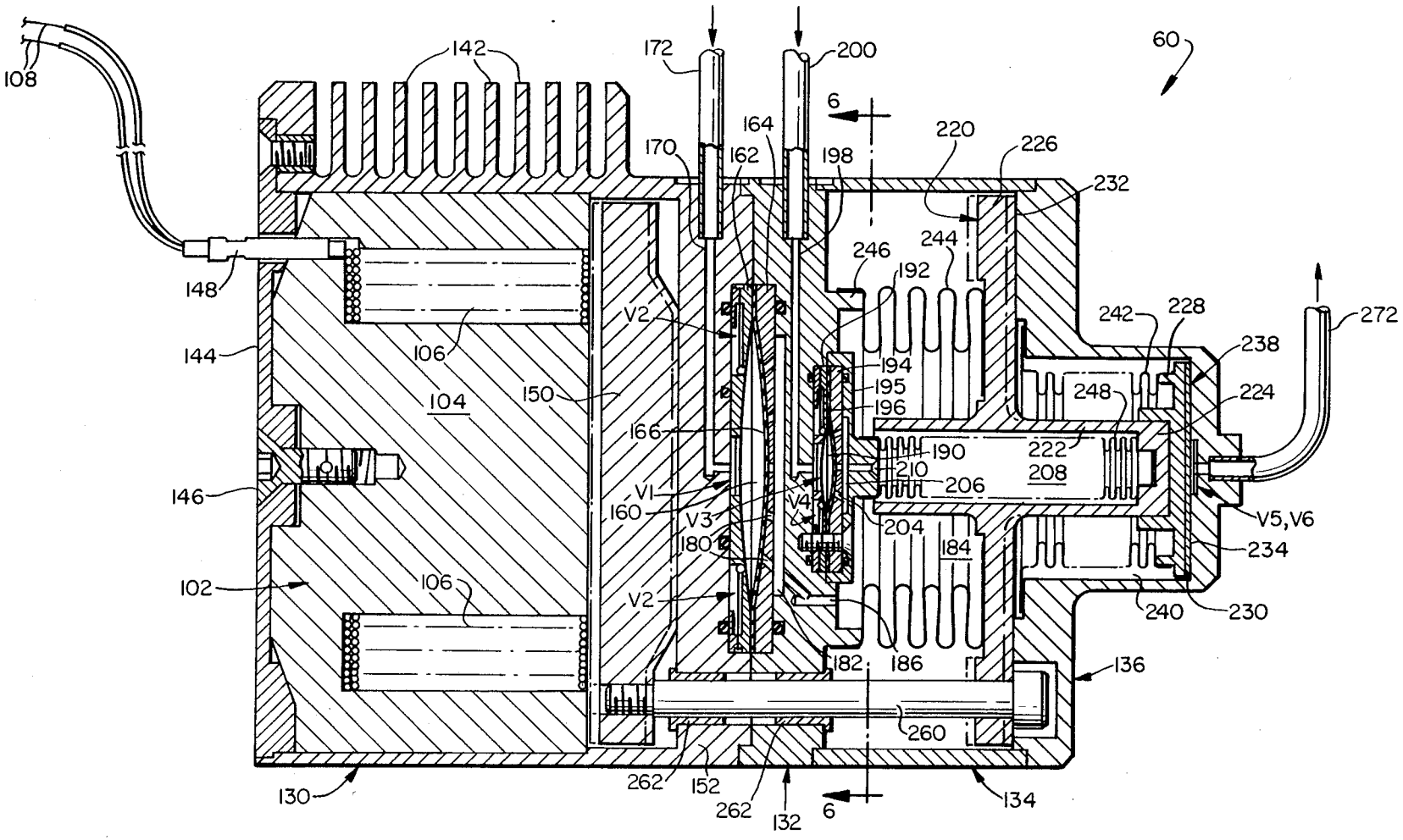
FIG. 4 is a longitudinal cross-sectional view taken along the lines 4—4 of FIG. 5 of compressor/expander apparatus in accordance with the invention.
Figure 5:
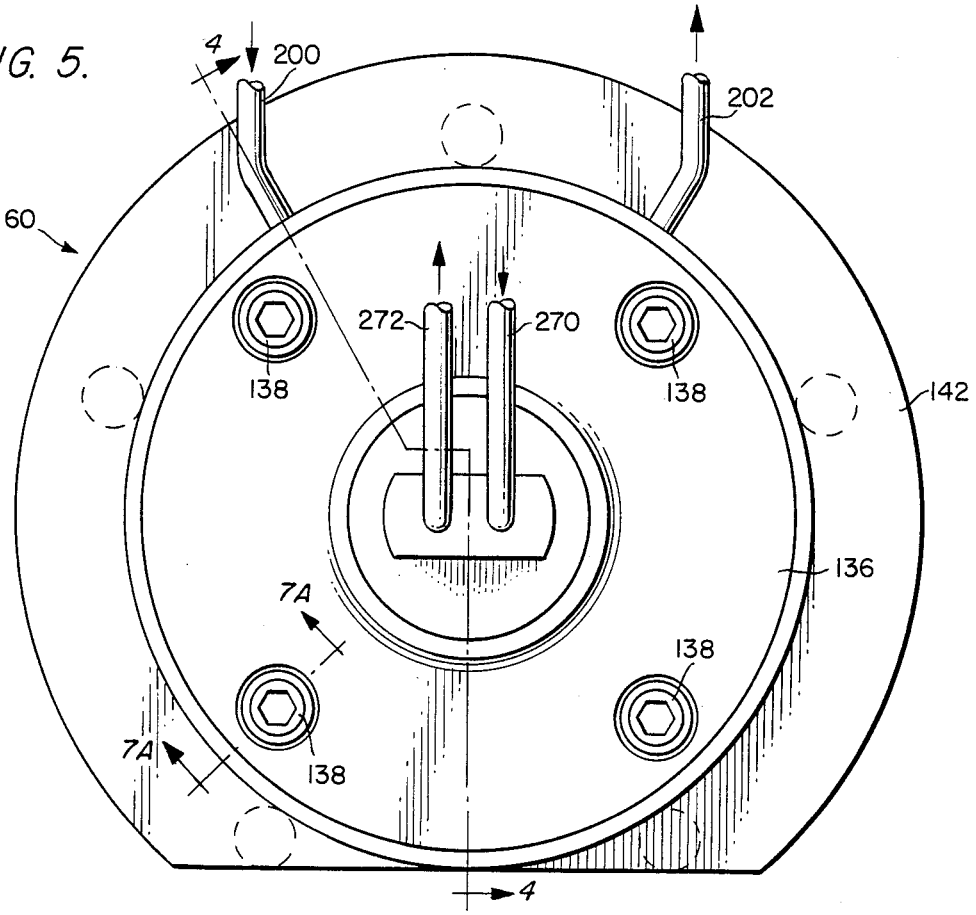
FIG. 5 is an end elevational view of the compressor-/expander apparatus of FIG. 4.
Figure 8:
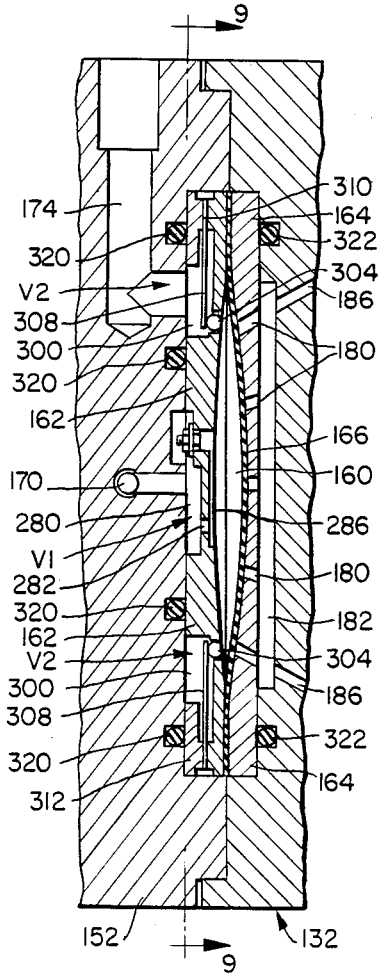
FIG. 8 is an enlarged fragmentary sectional view similar to FIG. 4, but taken from a different angle, of a portion of the compressor/expander apparatus.
Figure 7B:
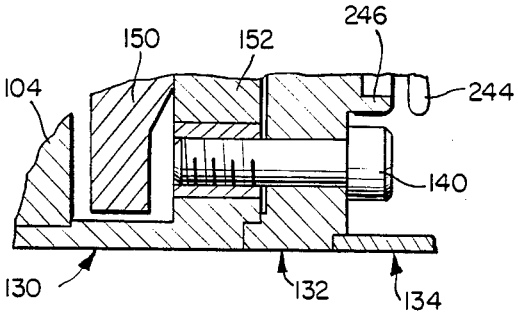

As shown in FIGS. 4 and 8, and as will be described in more detail shortly, the first stage of the compressor comprises a lenticular-shaped cavity 160 formed between the oppositely contoured walls of a pair of insert members 162 and 164 positioned within mating cut-outs formed in end wall 152 of the solenoid housing and in compressor plate 132. A dish-shaped resilient diaphragm 166, as of beryllium-copper alloy or stainless steel, may be disposed within the cavity and sandwiched between insert members 162 and 164, and is preferably shaped to conform to the wall surface of insert 164 within the cavity, as shown. Insert member 162 may include an inlet valve V1 in communication with the cavity and with a gas inlet passageway 170 formed in end wall 152 of the solenoid housing and an inlet line 172 from accumulator 64 (FIG. 2) and may also include a plurality of outlet valves V2 in communication with the cavity and with a gas outlet passageway 174 (see FIG. 8). (The valves will be described in more detail shortly).

As is also shown in FIGS. 4 and 8, insert member 164 may have a plurality of holes 180 therethrough that connect an oil (or other fluid) plenum 182 formed in compressor plate 132 to the right side (in the figures) of the diaphragm. The holes are preferably arranged to distribute oil pressure substantially uniformly to the diaphragm. The oil plenum is, in turn, connected to an oil reservoir 184 (to be described more fully shortly) via a plurality of oil passageways 186 through the compressor plate.

The second stage of the compressor may have the same construction as the first stage, except that it may be smaller since it is required to handle a smaller flow rate (25% of the flow rate of the first compressor stage, for example), and may comprise a lenticular-shaped cavity 190 formed between insert members 192 and 194 positioned within mating cut-outs in compressor plate 132 and a cover plate 195. A dish-shaped resilient diaphragm 196, which may also be of a beryllium-copper alloy or stainless steel, is disposed within the cavity and secured between insert members 192 and 194. Insert member 192 may include an inlet and outlet valve arrangement similar to that of the first stage, the inlet valve V3 connecting the cavity to a gas inlet passageway 198 and inlet line 200 (from accumulator 66), and the outlet valve arrangement V4 connecting the cavity to a gas outlet passageway in the cover plate and an outlet line 202 (shown in FIGS. 5 and 6). Insert member 194 may likewise have a plurality of holes 204 therethrough connecting the cavity to an oil plenum 206 in cover plate 195 that, in turn, communicates with an oil reservoir 208 via an oil passageway 210 in the cover plate.

As also shown in FIG. 4, disposed within the cylindrical housing extension 134 and the expander housing 136 is a piston member 220 comprising a tubular U-shaped (in cross-section) center portion 222 with a closed end 224, a centrally located radially directed circular flange 226 extending outwardly from the center portion, and a circular end plate 228 topped by a piston plate 230 connected to end 224 of the center portion, as shown. Flange 226 may have a diameter that is slightly less than the inner diameter of the cylindrical housing extension 134 and is preferably located on center portion 222 of the piston member so as to abut the end wall 232 of the expander housing within the cylindrical housing extension as piston plate 230 just engages the end wall 234 of the expander housing. This limits the travel of the piston member to the right in the figure.

End plate 228 and piston plate 230 constitute an expander piston 238 that is disposed within a cylindrical expansion chamber 240 of the expander housing, as shown. The end plate and piston plate may have a diameter slightly less than the inner diameter of the chamber. A resilient bellows 242 is connected at one end to end plate 228 and at the other end to the expander housing adjacent to wall 232. This provides a seal between expansion chamber 240 and the cylindrical housing extension 134, and avoids the necessity for sliding seals on the piston. Another resilient bellows 244 having one end sealingly connected to flange 226 of the piston member and one end sealingly connected to an annular flange 246 of compressor plate 132 defines the oil reservoir 184 for the first stage of the compressor. Similarly, a resilient bellows 248 disposed within the tubular center portion 222 of the piston member and connected to piston plate 195 defines oil reservoir 208 for the second stage of the compressor. The oil reservoirs may be connected to oil accumulator 96 (see FIG. 2) via oil passageways (not illustrated) formed in compressor plates 132 and 195. Bellows 242, 244 and 248 are preferably metallic and may be formed of electro-deposited nickel, for example.

Figure 6:
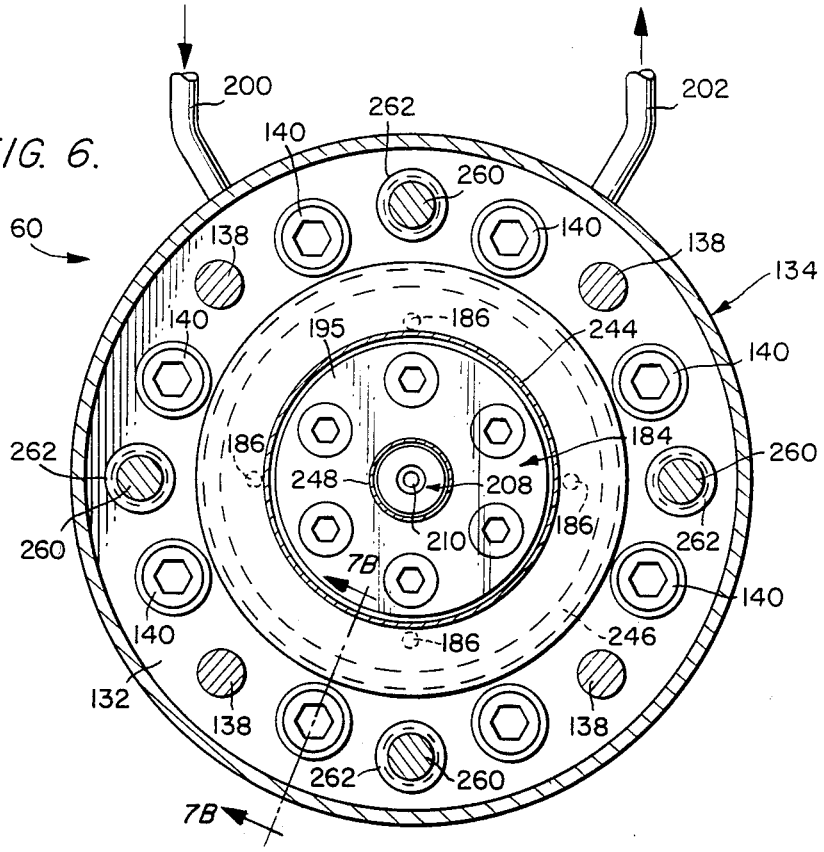
FIG. 6 is a transverse sectional view taken along the line 6—6 of FIG. 4.
Figure 7A:
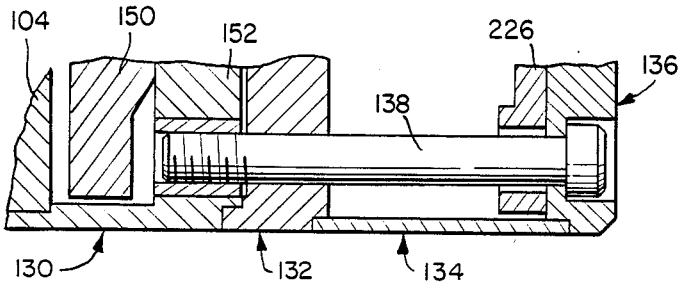
FIGS. 7A and 7B are fragmentary sectional views taken along the lines 7A—7A and 7B—7B of FIGS. 5 and 6, respectively.

Flange 226 of piston member 220 may be connected to solenoid armature 150 by a plurality of bolts 260 that extend through bushings 262 in compressor plate 132 and end wall 152 of the solenoid housing, as shown in FIGS. 4 and 6, and are threaded into the solenoid armature. Bolts 260 serve as guide pins (in cooperation with bushings 262) and constrain the piston member for movement with the solenoid armature. The positions of the solenoid armature and piston member shown in FIG. 4 correspond to the solenoid being unenergized. When the solenoid is energized, the solenoid armature and piston member are moved to the left in the figure to the positions shown in phantom lines. As will be described in more detail shortly, the inlet and outlet valves V5 and V6 of the expander may be disposed in wall 234 of the expander housing (see FIG. 12) to enable them to be controlled by the expander piston 238. The inlet and outlet valves are, respectively, in communication with inlet and outlet lines 270 and 272 (see FIG. 5 also) that connect the expander to heat exchanger 70.

Prior to describing the operation of the compressor-/expander of FIG. 4, the inlet and outlet valve arrangements for the first compressor stage and for the expander will first be described. As previously indicated, both compressor stages may employ similar valve arrangements. Accordingly, only the valve arrangements for the first stage will be described.

FIG. 8 illustrates the first stage of the compressor in somewhat more detail than FIG. 4 (and also from a different angle than FIG. 4). With respect to the inlet valve V1, as is shown in FIG. 8 and in greater detail in FIGS. 11A–B, gas inlet passageway 170 is in communication with a centrally located recess 280 in insert member 162 and with compressor cavity 160 via a hole 282 that extends through the insert member between recess 280 and the contoured surface 284 of the insert member that constitutes the left (in FIGS. 8 and 11A) wall of the cavity. A leaf spring 286 may be disposed within a mating depression or seat 288 formed in wall 284 and located so that one end of the leaf spring covers hole 282. The other end of the leaf spring may be connected, as by welding, to a threaded member 289 that extends through insert member 162 and is secured thereto with a nut 290 and a washer 292. The leaf spring constitutes a reed valve. When it flexes to the phantom line position shown in FIG. 11A, it uncovers hole 282 and allows gas to enter the cavity. In the solid line position, in which it is in engagement with its seat, it covers hole 282 and prevents gas in the cavity from being discharged therethrough. Leaf spring 286 is preferably selected to have a spring constant such that the inlet valve opens at an inlet line pressure slightly less than the desired inlet pressure, e.g., at approximately 2.5 psi. (The second stage inlet valve V3 may likewise have a leaf spring selected to open the valve at 125 psi).

FIGS. 8–10B illustrate a preferred outlet valve V2 arrangement which, as will be described, preferably comprises a plurality of ball valves. As is shown in the figures, insert member 162 may be formed with an annular recess 300 that is in communication with gas outlet line 174 in end wall 152 of the solenoid housing. A plurality of stepped-diameter holes 302 may extend through the insert member between annular recess 300 and cavity 160. Each hole serves as a valve seat for a small ball 304, as of stainless steel, that is disposed therein. Each ball may be biased into engagement with the small diameter portion 306 of the hole (corresponding to the closed position of the valve) by a radially inwardly directed resilient finger 308 of a generally annular-shaped leaf spring member 310 that is sandwiched between insert member 162 and an annular retaining ring 312. As shown in FIG. 1OB, the inner diameter edge 314 of the retaining ring serves to limit the travel of the resilient fingers 308 (to the phantom line position illustrated) to prevent the balls 304 from slipping out of holes 302 when the valves open. The outlet valves are normally held closed by the resilient fingers of the leaf spring, and they are all adapted to open at approximately the same time to allow gas in the cavity to be discharged into annular recess 300 and gas outlet passageway 174, in a manner which will be described shortly. Rather than leaf springs, individual compression springs for the balls may also be used.

Although in the form illustrated the inlet valve is a reed valve and the outlet valves are ball valves, both the inlet and outlet valves may be of the same type, such as reed valves, ball valves or other types of valves. Also, although the outlet valves are arranged in a circle about the inlet valve, other arrangements may be employed. For example, the outlet valves may be located close to the center of insert member 62 and one or more inlet valves may be disposed about the outlet valves. The reason for employing a plurality of outlet valves is to ensure the complete discharge of compressed gas from the cavity. As previously indicated, the gas within the cavity is compressed during the first part of the diaphragm stroke and is discharged from the cavity during the latter part of the stroke. The first stage has a compression ratio of the order of 10:1. The gas within the cavity is compressed during approximately 90% of the diaphragm stroke and is discharged during only the last 10% of the stroke. The plurality of outlet valves enables complete discharge of the compressed gas from the cavity during the relatively small discharge portion of the stroke. In contrast, a single inlet valve V1 is sufficient since gas can be supplied to the cavity during the entire return (intake) stroke of the diaphragm.

Figure 10A:
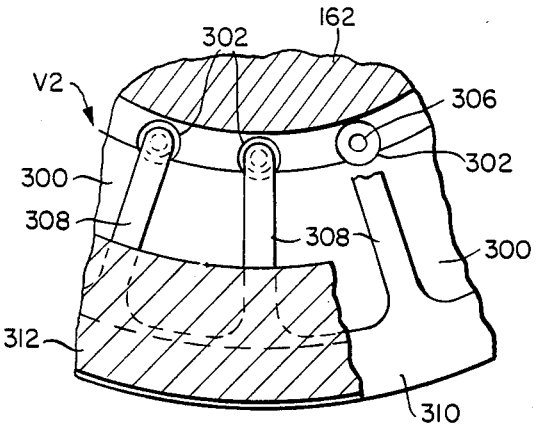
Figure 10B:
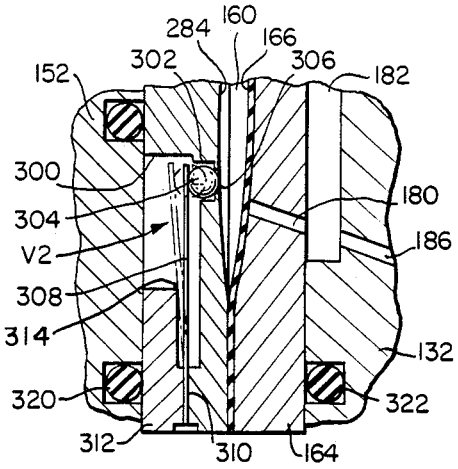
Figure 9:
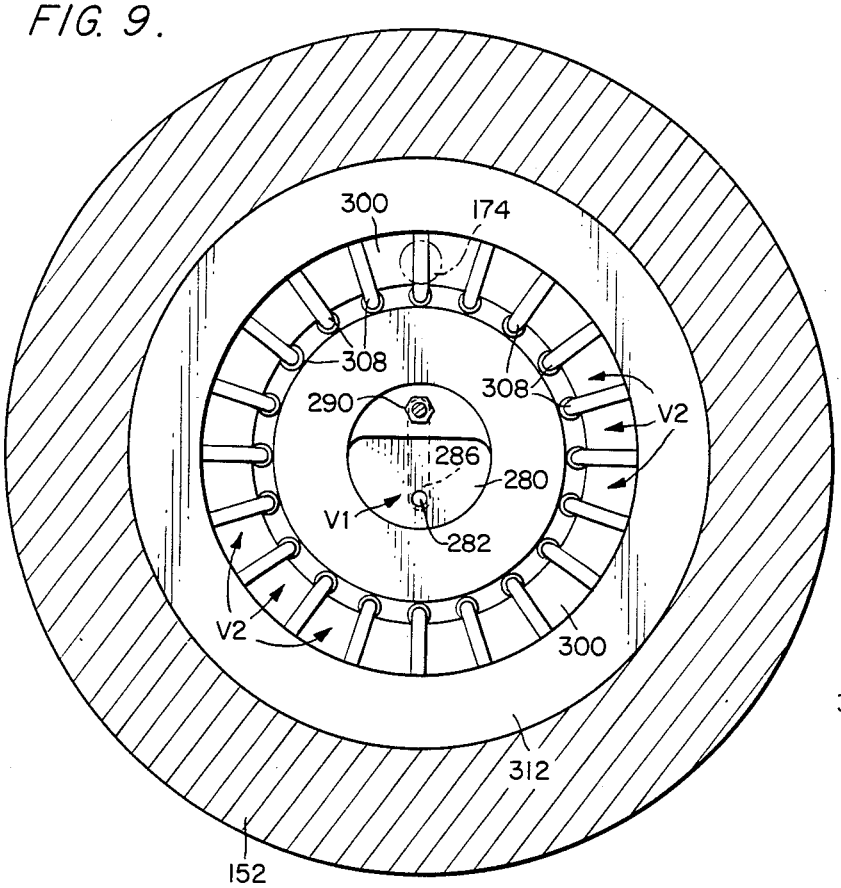
FIG. 9 is a sectional view taken along the line 9—9 of FIG. 8.

As shown in FIGS. 8 and 10B, seals 320, such as gaskets or O-rings, may be employed for sealing inlet cavity 282 and annular outlet cavity 300. Similarly, seals 322 may be employed between insert member 164 and compressor plate 132 for sealing oil plenum 182.

Figure 12:
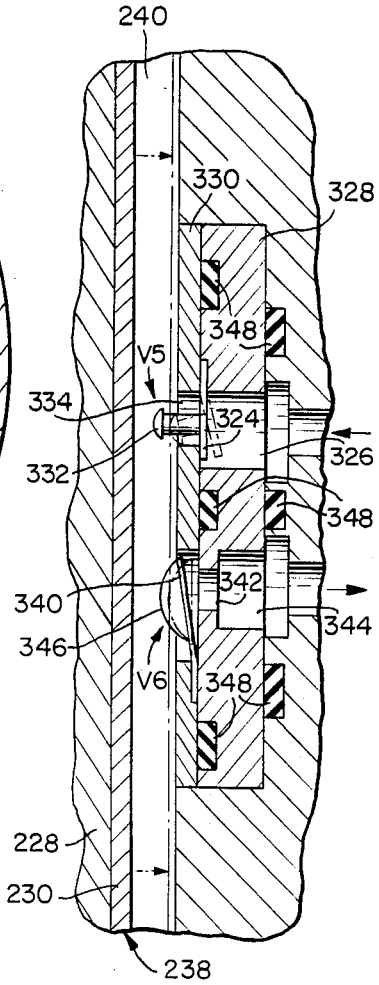
FIG. 12 is an enlarged fragmentary sectional view of a preferred inlet and outlet valve arrangement of the expander portion of the compressor/expander apparatus of FIG. 4.
Figure 11A:
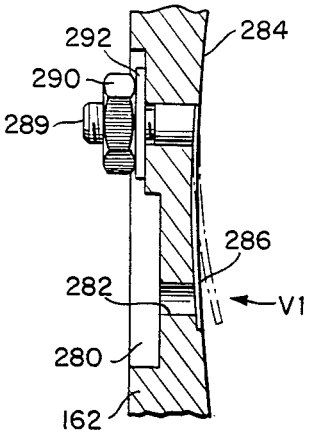
FIGS. 11A and 11B are, respectively, enlarged fragmentary sectional and plan views of portions of FIGS. 8 and 9 illustrating a preferred inlet valve arrangement.
Figure 11B:
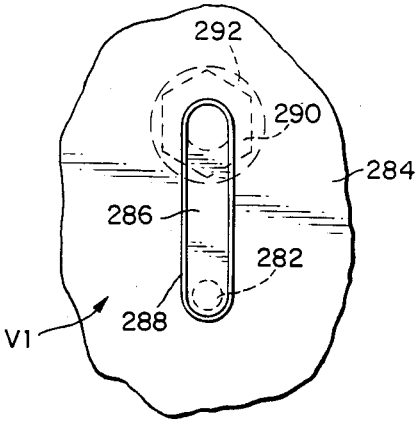

FIG. 12 illustrates a preferred arrangement for inlet valve V5 and outlet valve V6 of the expander. As shown, the inlet valve may comprise a leaf spring 324 disposed within a cavity 326 that is in communication with inlet line 270 (see FIG. 5). One end of the leaf spring is sandwiched between an insert member 328 and a retaining plate 330 disposed within wall 234 of the expander housing adjacent to expansion chamber 240. A rigid projection 332 connected to the leaf spring extends through an opening 334 in the retaining plate and into the chamber. The leaf spring is sized to cover opening 334 and is normally biased into engagement with the retaining plate so as to close the opening between cavity 326 and expansion chamber 240. This is the normally closed position of inlet valve V5.

Outlet valve V6 may similarly comprise a leaf spring 340 disposed between insert member 328 and retaining plate 330 and normally biased to uncover an opening 342 in the insert member that is in communication with a cavity 334 and outlet line 272. This is the normally open position of outlet valve V6. Leaf spring 340 may be formed with a resilient arcuate projection 346 that extends into expansion chamber 240, as shown. Gaskets 348 may be disposed between retaining plate 330 and insert member 328 and between insert member 328 and the expander housing, as shown, for sealing purposes.

Inlet valve V5 is normally closed and outlet valve V6 is normally open as noted above. In the position illustrated in FIG. 12, expander piston 238 is at the end of its expansion stroke, and expansion chamber 240 has its maximum volume. When the piston moves to the phantom line position illustrated in the figure (the top of its stroke corresponding to minimum expansion chamber volume), piston plate 230 engages projection 332 of leaf spring 324, causing the leaf spring to move to the phantom line position and open the inlet valve. This allows a charge of 130 psi gas to enter the expansion chamber. At the same time, piston plate 230 engages projection 346 of leaf spring 340 to move the leaf spring to the phantom line position corresponding to the closed position of the outlet valve. As the piston then moves to the left in the figure during the expansion stroke, leaf spring 324 returns to the solid line position to close the inlet valve, which is held closed because of the gas pressure in the inlet line. However, during the expansion stroke, the outlet valve remains in closed position because of the pressure of the gas within the expansion chamber. When the gas pressure in the expansion chamber drops to 3 psi (the pressure of the outlet line) at the end of the expansion stroke, the outlet valve opens, and the expanded gas is discharged as the piston moves back to the right in the figure during the discharge stroke.

The operation of the compressor/expander will now be described. The solid line positions of the components illustrated in FIG. 4 correspond to the beginning of a compression/expansion cycle. Upon solenoid 102 being energized, solenoid armature 150, piston member 226 and expander piston 238 move to the left in FIG. 4. This compresses bellows 244 and 248 causing the oil in reservoirs 184 and 208 to exert pressure against the right-hand sides (in the figure) of diaphragms 160 and 196, causing the diaphragms to displace to the left and to reduce the volumes of cavities 160 and 190 of the first and second compressor stages. This pressurizes the gas in the cavities. Inlet valves V1 and V3 are held closed during the compression stroke by the gas pressure in the cavities. During the first portion of the compression stroke, the outlet valves V2 and V4 are held closed, as previously indicated, because of the gas pressures in the outlet lines. When the gas pressures in the cavities reach the gas pressures in the outlet lines, the outlet valves open and the pressurized gas is discharged from the cavities during the last portion of the compression stroke. During the compression stroke, the gas in the expansion chamber 240 acts against piston 238 and does work by aiding the solenoid in moving piston member 220 to the left. At the end of the compression stroke (or shortly prior to the end of the stroke), the power to the solenoid is turned off. Solenoid armature 150, piston member 220 and expander piston 238 thereafter move back to the right in the figure because of the resiliency of the bellows and the force against the piston member produced by gas entering the cavities through inlet valves V1 and V3 that acts against the diaphragms to return the diaphragms to their original positions. During this movement, the expanded gas is discharged from the expansion chamber, as previously described. When the expander piston reaches the top of its stroke, a new charge of gas is taken into the expander and power is reapplied to the solenoid to repeat the cycle.

As may be appreciated from the foregoing, there are several significant advantages afforded by the invention. To begin with, it should be noted that the compressor/expander does not require close tolerances nor sliding seals which can deteriorate and cause contamination of the refrigerant. Thus, the compressor can be hermetically sealed. The construction of the compressor/expander also enables it to be made quite small and lightweight, and its simplicity affords high reliability. The fluid coupling between the expander and the compressor avoids the high fatigue and stress that is typically associated with mechanical (rigid) couplings, such as gears or levers, and the fluid coupling minimizes the pressure differentials that are applied to opposite sides of the diaphragms. This minimizes stress and fatigue and affords a long diaphragm life. The fluid coupling is also convenient for efficiently dissipating the heat of compression and contributes to a more efficient operation. As noted earlier, the fluid need not be incompressible. In some applications, a compressible fluid might be desirable for damping purposes.

The compressor/expander may be readily miniaturized, and a cooling system in accordance with the invention capable of providing flow rates and temperatures such as those given in connection with the discussion of FIGS. 2 and 3 may have dimensions of the order of 4 inches in diameter by 5 inches in length and a weight of the order of 4½ to 6 pounds, as noted above. Of course, cooling systems in accordance with the invention may also be larger and may be configured to accommodate different flow rates and different temperatures. They may also use another gas as a refrigerant, although argon is preferred, and may be easily adapted to employ other than electrical driving mechanisms.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Cooling apparatus comprising compressor means for compressing a gas, expander means for enabling expansion of a portion of the compressed gas and for enabling the expansion of the compressed gas to perform work, and fluid means connecting the expander means and the compressor means for applying said work of expansion to the compressor means to assist the compressor means in said compressing, wherein the compressor means is a diaphragm compressor comprising a housing having a cavity with a resilient diaphragm disposed therein, the diaphragm being displaceable by the fluid means for compressing gas within the cavity, wherein the fluid means comprises a fluid reservoir partially formed by a movable member, and fluid passageway means connecting the fluid reservoir to a first side of the diaphragm, and wherein the expander means comprises a portion of the movable member disposed within an expansion chamber in the housing, the movable member being movable in a direction to increase the volume of the expansion chamber while simultaneously decreasing the volume of the fluid reservoir so as to cause fluid in the reservoir to exert pressure against the diaphragm and to displace the diaphragm in a direction to compress gas within the cavity.

2. The apparatus of claim 1, wherein said fluid passageway means comprises a first plurality of fluid passageways connecting the fluid reservoir to a fluid plenum, and a second plurality of fluid passageways connecting the fluid plenum to the first side of the diaphragm, the second plurality of fluid passageways being arranged so as to distribute the fluid pressure substantially uniformily to the first side of the diaphragm.

3. The apparatus of claim 1, wherein the fluid reservoir comprises a flexible resilient bellows connected to the movable member and to the housing.

4. The apparatus of claim 1 wherein the movable member is rigid member and the portion disposed within the expansion chamber comprises a piston.

5. The apparatus of claim 4 further comprising an inlet valve and an outlet valve in communication with the expansion chamber and respectively connected to gas inlet means and gas outlet means, the valves being arranged so as to be operated by the piston.

6. The apparatus of claim 5, wherein the inlet valve and the outlet valve each comprise a leaf spring having a projecting portion within the chamber that is adapted to be engaged by the piston, engagement of the projecting portions by the piston being operative to open the inlet valve and to close the outlet valve.

7. The apparatus of claim 6, wherein upon the piston opening the inlet valve, a charge of compressed gas is introduced into the chamber from the gas inlet means that acts against the piston to move the piston and the movable member in said direction to compress gas in the cavity and to allow the compressed gas in the chamber to expand, the inlet valve leaf spring being formed to cooperate with the pressure of the compressed gas in the gas inlet means to close the inlet valve upon such movement of the piston, and the outlet valve leaf spring being formed to cooperate with the pressure of the compressed gas in the chamber to maintain the outlet valve closed during such movement until the pressure in the chamber decreases to the pressure of the gas outlet means.

8. The apparatus of claim 4 further comprising a bellows having one end sealingly connected to the piston and another end sealingly connected to the housing so as to avoid the necessity for sliding seals between the piston and the chamber walls.

9. The apparatus of claim 1 further comprising electrical means for moving the movable member in said direction to compress gas within the cavity.

10. The apparatus of claim 9, wherein the electrical means comprises a solenoid having an armature connected to the movable member, the solenoid adapted to be energized by a pulsed voltage so as to cause reciprocation of the movable member.

11. The apparatus of claim 10 further comprising pressure regulating switch means for monitoring the pressure of compressed gas from the compressor and for controlling actuation of the solenoid so as to maintain a desired pressure.

12. Cooling apparatus comprising compressor means for compressing a gas, expander means for enabling expansion of a portion of the compressed gas and for enabling the expansion of the compressed gas to perform work, and fluid means connecting the expander means and the compressor means for applying said work of expansion to the compressor means to assist the compressor means in the said compressing, wherein the compressor means is a diaphragm compressor comprising a housing having a cavity with a resilient diaphragm disposed therein, the diaphragm being displaceable by the fluid means for compressing gas within the cavity, wherein the cavity has a lenticular shape and is formed between oppositely contoured walls of first and second members disposed within the housing, the diaphragm being securely held between the first and second members and having a shape that conforms to the contoured wall of the first member, and further comprising a gas inlet valve disposed in the wall of said second member, the inlet valve comprising a leaf spring biased into engagement with the wall so as to cover an opening therein that is in communication with a gas inlet passageway, the leaf spring being formed to open to admit gas into the cavity when the pressure in the cavity is approximately equal to the pressure in the inlet gas passageway.

13. Cooling apparatus comprising compressor means for compressing a gas, expander means for enabling expansion of a portion of the compressed gas and for enabling the expansion of the compressed gas to perform work, and fluid means connecting the expander means and the compressor means for applying said work of expansion to the compressor means to assist the compressor means in said compressing, wherein the compressor means is a diaphragm compressor comprising a housing having a cavity with a resilient diaphragm disposed therein, the diaphragm being displaceably by the fluid means for compressing gas within the cavity, wherein the cavity has a lenticular shape and is formed between oppositely contoured walls of first and second members disposed within the housing, the diaphragm being securely held between the first and second members and having a shape that conforms to the contoured wall of the first member, and further comprising a plurality of outlet valves disposed within an annular recess in the second member, the recess being in communication with a gas outlet passageway, each outlet valve comprising an opening through the wall of the second member connecting the cavity to the annular recess, a ball disposed within the opening, and spring means for biasing the ball to engagement with the sides of the opening so as to close the outlet valve to prevent the passage of gas therethrough.

14. The apparatus of claim 13, wherein the spring means are formed to maintain the outlet valves closed until the pressure in the cavity is approximately equal to the pressure in the gas outlet passageway.

15. The apparatus of claim 13, wherein the spring means comprises a generally annular leaf spring member having a plurality of radially directed resilient fingers extending therefrom, each finger engaging a ball for biasing the ball into engagement with the sides of said opening.

16. The apparatus of claim 15, wherein the leaf spring member is disposed between the second member and a retaining ring such that the resilient fingers extend into the annular recess, the retaining ring being formed to engage the resilient fingers to limit their travel so as to prevent the balls from slipping out of the opening.

17. Cooling apparatus comprising diaphragm compressor means for compressing a gas, first expander means for receiving a first portion of compressed gas from the compressor means and for enabling expansion of the gas and for enabling the expansion of the gas to perform work, means for applying said work to the compressor means to assist the compressor means in compressing the gas, second expander means for receiving a second portion of compressed gas from the compressor means and for expanding the gas to liquefy a part thereof, and means for returning the expanded gas from the first and second expander means to the compressor means for recompression.

18. The apparatus of claim 17 further comprising heat exchanger means for cooling the portions of compressed gas prior to expansion, said cooling being effected by returning said expanded gas from the first and second expander means to the compressor means through the heat exchanger means.

19. The apparatus of claim 18, wherein said second expander means comprises an expansion valve disposed within a dewar, the second portion of compressed gas being supplied to the expansion valve and the expanded gas being returned from the dewar via a coaxial transfer line.

20. The apparatus of claim 19, wherein the coaxial transfer line comprises a flexible inner supply line surrounded by a flexible outer return line.

21. The apparatus of claim 19 further comprising back pressure regulating means for controlling the pressure within the dewar to control the temperature of the liquefied gas.

22. The apparatus of claim 21, wherein the apparatus comprises a cryogenic cooling system for cooling an object disposed within the dewar, and wherein the said temperature is of the order of 4°–100° Kelvin.

23. The apparatus of claim 17, wherein said compressor means comprises a diaphragm disposed within a cavity, and wherein said work applying means comprises a fluid coupling between said diaphragm and the first expander means, and movable means responsive to the expansion of gas in the first expander means for causing the fluid to exert pressure against the diaphragm to compress gas within the cavity.

24. The apparatus of claim 23, wherein the compressor means further includes electrically operated driving means associated with the fluid coupling for causing the fluid to exert pressure against the diaphragm to compress gas within the cavity.

25. The apparatus of claim 24, wherein said movable means comprises a movable member disposed within an expansion chamber of the first expander means, and wherein said electrically operated driving means comprises a solenoid having an armature connected to the movable member.

26. The apparatus of claim 17, wherein said compressor means comprises a dual stage compressor having a first stage for providing a first compressed gas output, a portion of which constitutes said first portion of compressed received by the first expander means and the remaining portion of which is supplied to a second stage of the compressor, the second stage providing a second compressed gas output that constitutes said second portion of compressed gas received by the second expander means, the first portion of compressed gas received by the first expander means comprising approximately 75% of said first compressed gas output.

27. Cooling apparatus comprising compressor means for compressing a gas, expander means comprising a movable member disposed within an expansion chamber for enabling expansion of the gas and for enabling the expansion of the gas to perform work, the expansion chamber having an inlet valve and an outlet valve for respectively admitting and discharging gas and the valves being arranged so as to be operated by the movable member, means for moving the movable member, and means for applying said work to the compressor means.

28. The apparatus of claim 27, wherein the inlet valve comprises a first leaf spring biased to normally close a gas inlet passageway to the chamber and the outlet valve comprises a second leaf spring normally biased to open a gas outlet passageway from the chamber, the first and second leaf springs each having a portion projecting into the chamber so as to be engaged by the movable member to enable the movable member to open the inlet valve and to close the outlet valve.

29. The apparatus of claim 28, wherein the first leaf spring is formed to cooperate with the pressure in the gas inlet passageway to close the gas inlet passageway upon the movable member moving out of an engaging position, and wherein the second leaf spring is formed to cooperate with the pressure of the gas within the chamber to maintain the gas outlet passageway closed until the gas pressure within the chamber drops to a predetermined value.

30. The apparatus of claim 27, wherein the compressor means comprises a cavity having another movable member disposed therein for compressing gas within the cavity, inlet valve means for admitting gas to the cavity, and outlet means for discharging compressed gas from the cavity, the outlet valve means comprising a plurality of outlet valves disposed within a recess between the cavity and a gas outlet passageway.

31. The apparatus of claim 30, wherein the outlet valves comprise a plurality of balls, each associated with an opening between the cavity and the recess, and a leaf spring member having a plurality of resilient fingers, each finger engaging a ball to bias the ball into engagement with its opening to prevent the passage of gas therethrough.

32. The apparatus of claim 31, further comprising means for engaging the resilient fingers to limit their travel so as to prevent the balls from slipping out of the openings.

33. Cooling apparatus comprising two-stage compressor means for compressing a gas, first expander means for receiving a first portion of compressed gas from the first stage of the compressor means for enabling expansion of the gas and for enabling the expansion of the gas to perform work, means for applying said work to the compressor means to assist the compressor means in compressing the gas, means for applying a second portion of compressed gas from the first stage of the compressor means to the second stage of the compressor means, second expander means for receiving said second portion of compressed gas after compression by the second stage of the compressor means and for expanding the gas for cooling purposes, and means for returning the expanded gas from the first and second expander means to the first stage of the compressor means for recompression.

34. The cooling apparatus of claim 33, further comprising heat exchanger means for cooling the gas applied by said first and second stages of the compressor means to said first and second expander means, respectively.

35. The apparatus of claim 34, wherein the returning expanded gas from the first and second expander means is passed through the heat exchanger means to cool the gas applied to said first and second expander means.

36. The apparatus of claim 35, wherein said second expander means comprises means for performing Joule-Thomson expansion.

37. The apparatus of claim 36, wherein said compressor means is an electromagnetically driven dual diaphragm compressor.

* * * * *